US006948590B1

(12) United States Patent
Hogeland et al.

(10) Patent No.: US 6,948,590 B1
(45) Date of Patent: Sep. 27, 2005

(54) REDUNDANT SYSTEMS UTILIZING INFLATABLE DEVICES IN ASSOCIATION WITH UTILITY STRUCTURES

(75) Inventors: Robert Clint Hogeland, Fultondale, AL (US); Frederick James Diggle, III, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 52 days.

(21) Appl. No.: 10/645,056

(22) Filed: Aug. 21, 2003

(51) Int. Cl.[7] ..... A62B 1/22; A47G 9/06; A47C 16/00

(52) U.S. Cl. ..... 182/137; 5/420; 5/706; 5/655.3

(58) Field of Search ..... 182/137, 134, 182/129, 230; 5/417, 420, 706, 655.3

(56) References Cited

U.S. PATENT DOCUMENTS 452,234 A * 5/1891 Perry ..... 182/137
1,166,811 A * 1/1916 Bowers ..... 182/137
2,143,122 A * 1/1939 Dawson ..... 182/137
2,945,550 A * 7/1960 Andreasen ..... 182/137
3,310,818 A * 3/1967 Fischer ..... 5/420
3,399,407 A * 9/1968 Olsen ..... 5/420
3,840,922 A * 10/1974 Morrison et al. ..... 182/137
3,851,730 A * 12/1974 Scurlock ..... 182/137
5,150,767 A * 9/1992 Miller ..... 182/137
5,203,427 A * 4/1993 Williams et al. ..... 182/137

* cited by examiner

*Primary Examiner*—Hugh B. Thompson, II
(74) *Attorney, Agent, or Firm*—Potomac Patent Group PLLC

(57) ABSTRACT

In one embodiment, a redundant system is provided which is structured for use in association with a utility structure having an external surface configuration perimeter. The system includes an inflatable device including a body having at least one surface structured for receiving an impact of at least one descending object, the body defining at least one opening structured to receive therein at least a portion of the external surface configuration perimeter of the utility structure; and, at least one inlet operatively associated with the body of the inflatable device, the inlet being structured to receive at least one type of fluid media into the body for inflating the inflatable device.

20 Claims, 5 Drawing Sheets

REDUNDANT SYSTEMS UTILIZING INFLATABLE DEVICES IN ASSOCIATION WITH UTILITY STRUCTURES

BACKGROUND

In many commercial and industrial settings, work sites at which work is performed may be associated with utility structures or other elevated structures. Scaling such elevated structures is often required by workers performing maintenance, installation and/or other related functions on equipment located at such elevated work sites. In elevated work environments, it may be difficult for workers to manipulate work tools and perform work on equipment at the work site, while also maintaining a reasonably stable physical position on a utility pole, for example, or another elevated structure associated with the work site. Workers who are inexperienced with working in elevated environments may be affected by psychological effects associated with such environments. In addition, if work on an elevated structure is necessary under adverse weather conditions, for example, or at night with diminished illumination sources, and/or if the work requires fine motor skills and enhanced concentration (as may be needed for working with relatively small equipment components, for example), maintaining stability on an elevated structure may be a concern.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risks presented by objects potentially descending from elevated structures, for example, it is nonetheless difficult to eliminate all risks to workers performing work on such elevated structures.

What are needed, therefore, are redundant systems for promoting safety of workers on elevated utility structures may be used. Such redundant systems may be beneficial in addition to the myriad existing support systems, methods, devices and/or other apparatus employed by workers on elevated structures to reduce or mitigate risks associated with objects potentially descending from utility structures, for example.

SUMMARY

In one embodiment of the present embodiments, a redundant system is provided which is structured for use in association with a utility structure having an external surface configuration perimeter. The system includes an inflatable device including a body having at least one surface structured for receiving an impact of at least one descending object, the body defining at least one opening structured to receive therein at least a portion of the external surface configuration perimeter of the utility structure; and, at least one inlet operatively associated with the body of the inflatable device, the inlet being structured to receive at least one type of fluid media into the body for inflating the inflatable device.

In another embodiment of the present embodiments, a redundant system is provided that is structured for use in association with a utility structure having an external surface configuration perimeter. The system includes an inflatable device including a body having at least one surface structured for receiving an impact of at least one descending object, the body defining at least one opening structured to receive therein at least a portion of the external surface configuration perimeter of the utility structure; at least one inlet operatively associated with the body of the inflatable device, the inlet being structured to receive at least one type of fluid media into the body for inflating the inflatable device; at least one exhaust port operatively associated with the body of the inflatable device; at least one inflation device operatively associated with the inlet of the inflatable device; at least one control system configured for operative association with at least one of the inflation devices; at least one power source configured for supplying power to at least one of the inflation devices, wherein at least one of the power sources includes a battery of a maintenance vehicle; and, at least one communication device configured for communicating commands to at least one of the control systems.

In another embodiment of the present systems, a redundant system is provided that is structured for use in association with a utility structure having an external surface configuration perimeter. The system includes an inflatable device including a body having a first portion defining at least one opening structured to receive therein at least a portion of the external surface configuration perimeter of the utility structure, the body having a second portion having at least one surface portion structured for receiving an impact of at least one descending object; and, at least one inlet operatively associated with the body of the inflatable device, the inlet being structured to receive at least one type of fluid media into the body for inflating the inflatable device.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

DESCRIPTION

As used herein, the term "utility structure" includes, for example and without limitation, telephone poles and other structures supporting utility related equipment and services such as, for example, telephone services, Internet services, electricity services and/or television/cable services; scaffolding; radio towers; oil rigs; buildings; construction sites for buildings and other erections; structures that require elevation of a worker; and/or any other structures suitable for use in association with the various system embodiments discussed herein.

As used herein, the term "inflation media" can include any fluid substance suitable for use to inflate an inflatable device as provided in accordance with the present redundant system embodiments. Examples of "inflation media" include, without limitation, air, carbon dioxide, helium, and/or other suitable fluid substances.

As used herein, the term "descending object" includes any object, whether animate or inanimate, descending from a first elevation to a second elevation.

Figure 1:
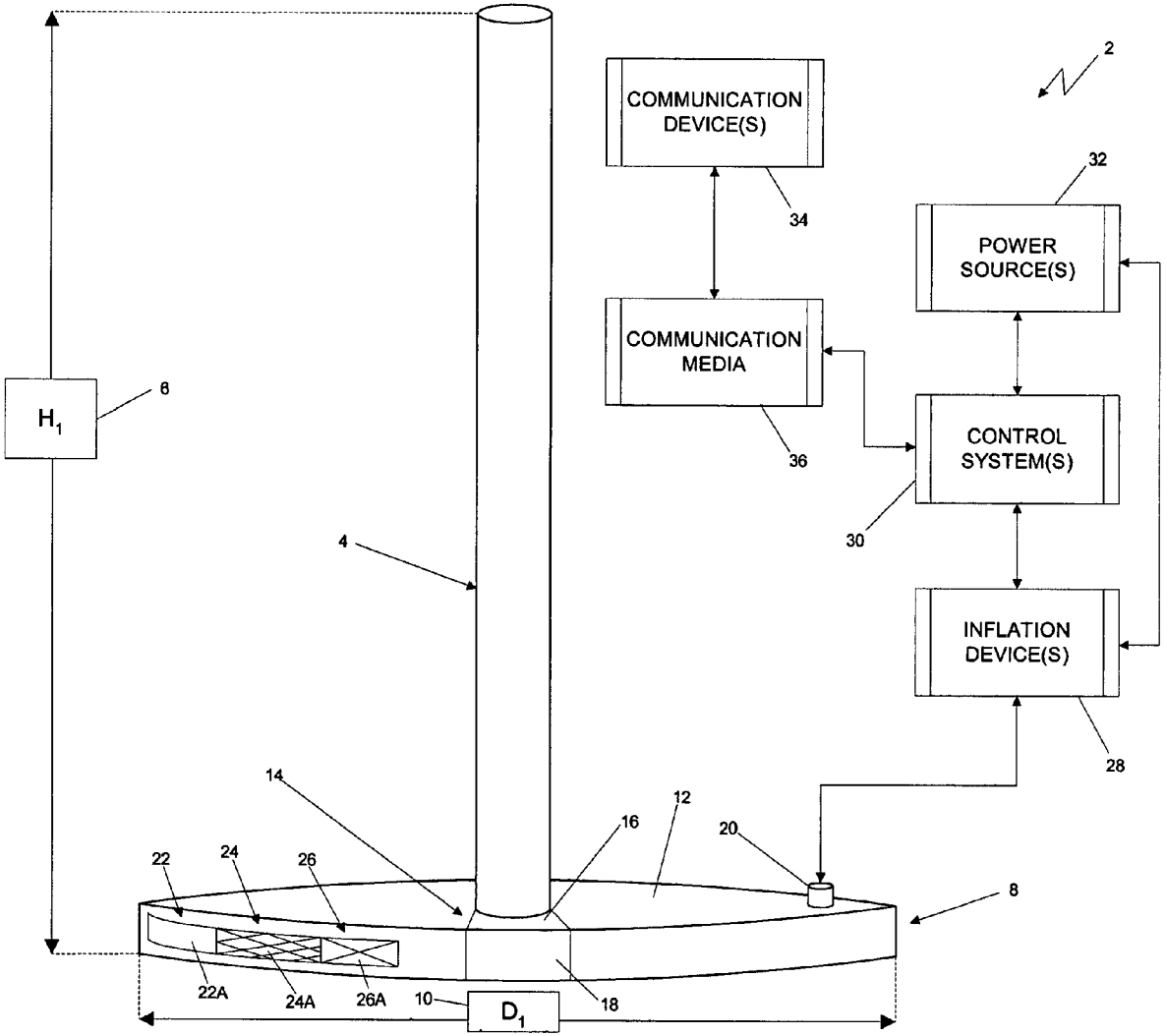
FIG. 1 includes a schematic illustrating various example embodiments provided in accordance with the present system embodiments.
Figure 2:
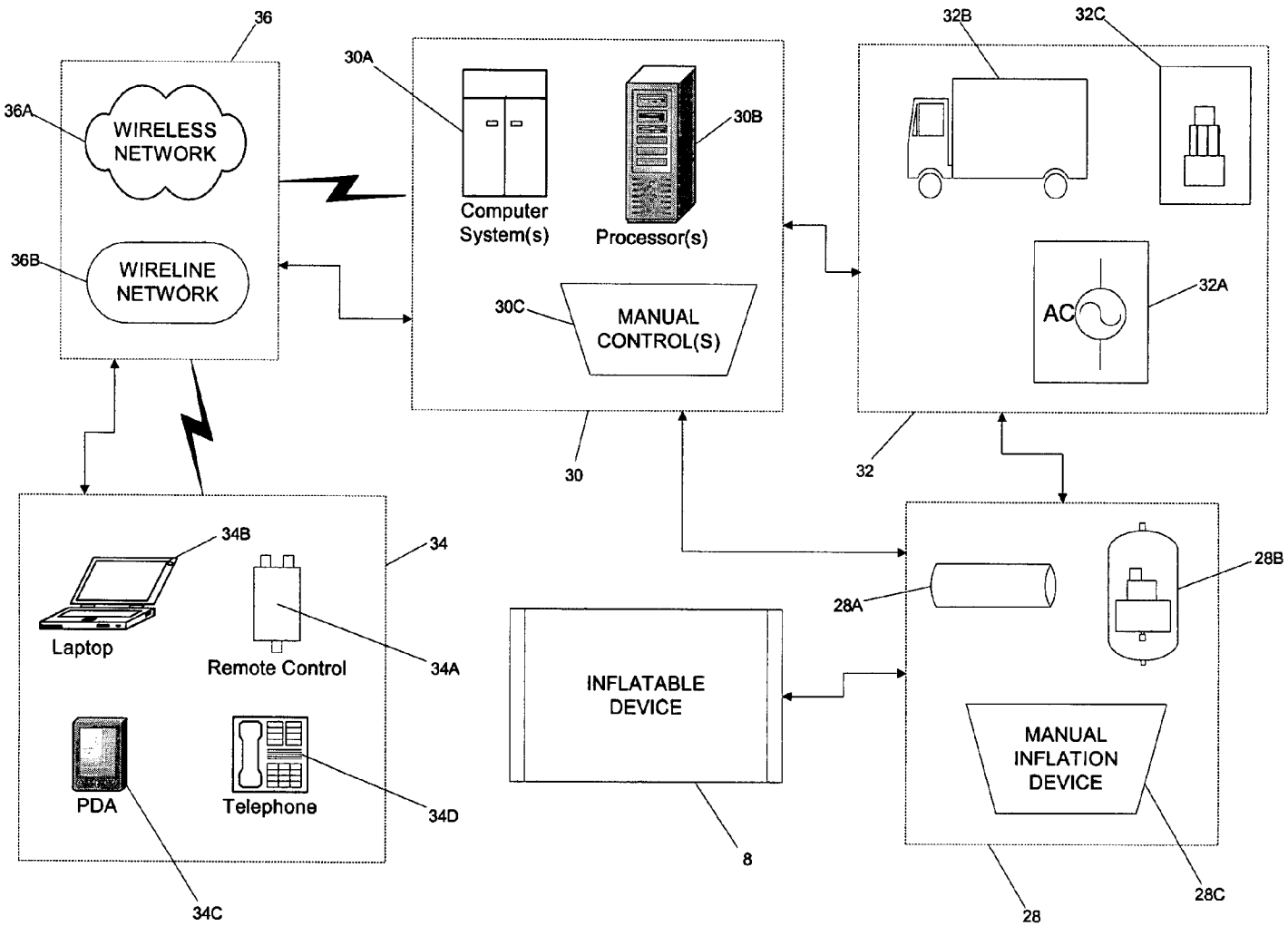
FIG. 2 includes a schematic illustrating further details of the example embodiments shown in FIG. 1.

Referring now to FIGS. 1 and 2, various example embodiments associated with a redundant system 2 are shown in accordance with the present system embodiments. A utility structure 4 having a height $H_1$ (6) is operatively associated with an inflatable device 8 having a diameter $D_1$ (10). In one aspect, the height $H_1$ (6) of the utility structure 4 can be provided in the range from approximately 20 feet to 70 feet. In another aspect, the ratio of the diameter $D_1$ (10) of the inflatable device 8 to the height $H_1$ (6) of the utility structure 4 can be provided in the range of approximately 40% to 50%. As shown, the inflatable device 8 is in a substantially non-inflated form and includes a generally circular body 12 encircling at least a portion of an external surface configuration perimeter of the utility structure 4. In one aspect, an opening 14 can be formed in the body 12 of the inflatable device 8 suitably dimensioned to receive the external surface configuration perimeter of the utility structure 4 and position the opening 14 in contact with the external surface configuration perimeter of the utility structure 4. In another aspect, one or more flaps 16,18 can be structured for attachment to the body 12 of the inflatable device 8 to cover the opening 14 in association with installation of the inflatable device 8 around the external surface configuration perimeter of the utility structure 4. In various embodiments, the flaps 16,18 can be connected to the body 12 of the inflatable device 8 by use of snaps, buttons, Velcro, and/or other conventional fastening means to substantially cover the opening 14 during operation of the redundant system 2.

In various embodiments, the inflatable device 8 can be comprised of a material such as, for example and without limitation, nylon, parachute material, polypropylene, plastic, rubber and/or other like materials. It can be appreciated that the selection of material from which the inflatable device 8 is manufactured can be based on the ability to manipulate the inflatable device 8 into a relatively compact form for convenient installation or manipulation of the inflatable device 8 and/or for transportation of the inflatable device 8 to/from a work site where the utility structure 4 is deployed.

In another embodiment, the inflatable device 8 can be provided with an inlet 20 connected to the body 12 of the inflatable device 8, which inlet 20 is structured to receive and communicate a volume of one or more types of fluid media into the body 12 to inflate the inflatable device 8 from a non-inflated state. In one aspect, one or more exhaust ports such as exhaust ports 22,24,26, for example, can be provided in operative association with various portions of the body 12 of the inflatable device 8, as shown. In operation of the redundant system 2, the exhaust ports 22,24,26 permit a fluid media to be exhausted from the inflatable device 8 such as when a descending object, for example, strikes and exerts a force on a surface of the inflatable device 8. It can be appreciated that permitting fluid media to be exhausted from the inflatable device 8 enhances the capacity of the inflatable device 8 to absorb the force of impact (such as the force of impact of a descending object, for example) or at least to communicate the force of impact, and its associated effects, through the body 12 of the inflatable device 8 and away from the site of impact.

In one aspect, the exhaust port 22 can be provided as an opening 22A, for example, that permits fluid media to be exhausted from the interior of the inflatable device 8. In another aspect, the exhaust port 24 can be provided with a flap 24A, for example, connected to the body 12 of the inflatable device 8 with Velcro, for example, or another conventional fastening means capable of permitting detachment of the flap 24A from the body 12, such as when interior pressure is exerted on the flap 24A as a consequence of force applied to the body 12, such as by the impact of a descending object, for example, with the inflatable device 8. It can be seen that detachment of the flap 24A creates at least a partial opening to permit fluid media to be exhausted from the interior of the inflatable device 8. In another aspect, the exhaust port 26 can be provided with a breakable membrane 26A capable of breaking at least partially, such as when interior pressure is exerted on the membrane 26A as a consequence of force applied to the body 12, such as by the impact of a descending object, for example, with the inflatable device 8. In one aspect, the breakable membrane 26A permits at least a partial opening to form in the exhaust port 26 to permit a volume of fluid media to be exhausted from the interior of the body 12 of the inflatable device 8.

Referring again to FIGS. 1 and 2, other example embodiments of the present redundant system embodiments are shown. In various aspects, one or more inflation devices 28 can be employed to introduce one or more types of fluid media into the inflatable device 8. The inflation devices 28 may include, for example and without limitation, a carbon dioxide cartridge 28A, an air compressor 28B, and/or a manual inflation device 28C, among other suitable types of devices. In various other aspects, one or more control systems 30 can be used to activate and/or control, from a remote location or a location associated in proximity with the work site, one or more of the inflation devices 28. The control systems 30 can include, for example and without limitation, one or more computer systems 30A, one or more processors 30B, and/or one or more manual controls 30C, among other types of suitable control systems 30. In various other aspects, one or more power sources 32 can be operatively associated with one or more of the inflation devices 28 and/or one or more of the control systems 30. The power sources 32 can include, for example and without limitation, a conventional AC power source 32A (e.g., an electrical outlet located at or near the work site), a maintenance vehicle 32B (e.g., a battery of the maintenance vehicle 32B can be used as a power source 32), and/or a generator 32C (such as a gas-powered electric generator, for example) which may be portable or substantially fixed at the work site, among other suitable types of power sources 32. In one operational example, the redundant system 2 includes a portable generator 32C in operative association with a manual control 30C for actuating a portable air compressor 28B to introduce air, for example, as a fluid media into the inflatable device 8 and inflate the inflatable device 8 for use in connection with work performed in association with the utility structure 4.

In other example embodiments of the present redundant system embodiments, one or more communication devices 34 can be used in operative association with one or more of the control systems 30 through communication with one or more appropriate communication media 36. In various aspects, the communication devices 34 can include, for example and without limitation, a remote control device 34A, a laptop 34B, a personal digital assistant ("PDA") 34C, and/or a telephone 34D (e.g., a wireless, cellular or wireline telephone), among other types of suitable communication devices 34. The communication devices 34 can communicate with one or more of the control systems 30 through communication media 36 including, for example and without limitation, a wireless network 36A or a wireline network 36B. In one operational example, the inflatable device 8 can be installed in a substantially non-inflated state. In this example, a worker scales the elevated utility structure 4 and activates the PDA 34C to communicate through the wireless network 36A as the communication media 36 with the computer system 30A control system. In this example, the computer system 30A can receive commands input by the worker through the PDA 34C and can direct the air compressor 28B to activate and introduce air into the inlet 20 of the inflatable device 8. In this manner, the worker can control introduction and exhaust of fluid media into/from the body 12 of the inflatable device 8 from an elevated position on the utility structure 4.

Figure 3:
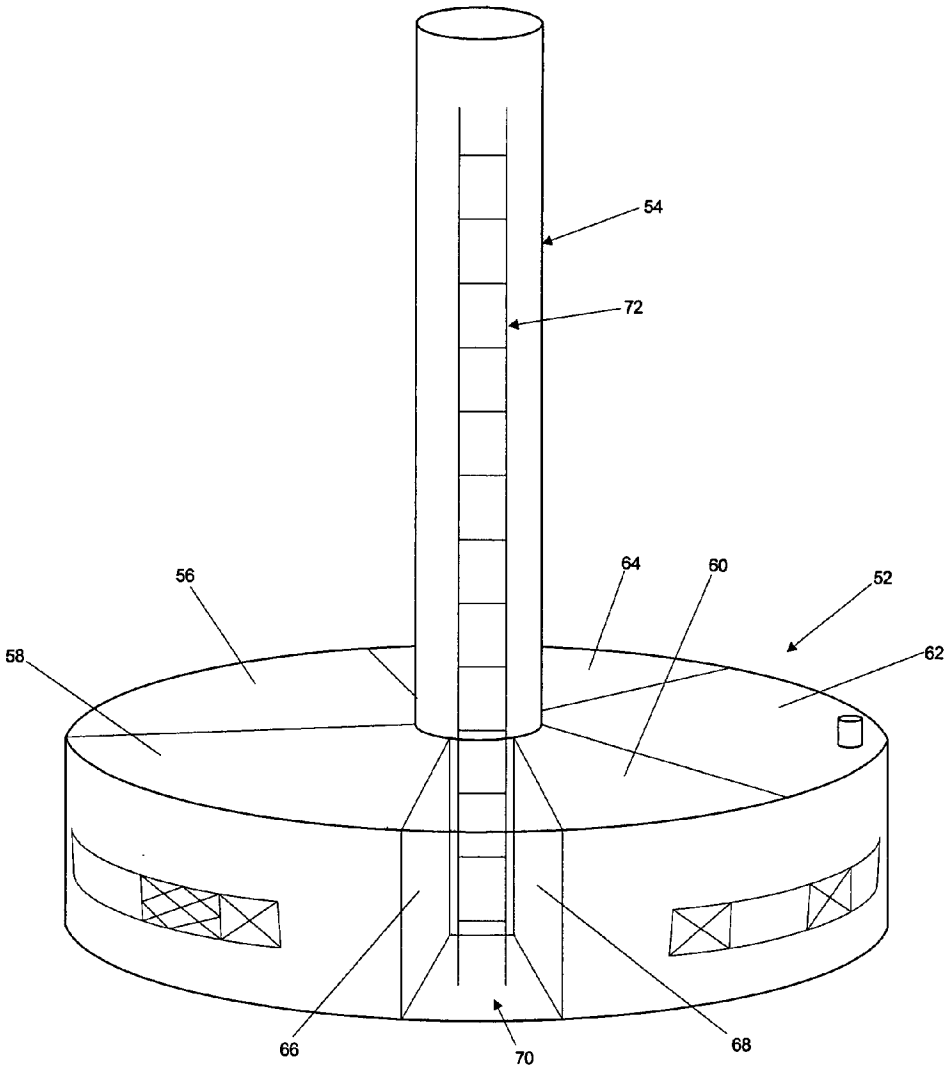
FIG. 3 includes an isometric view of an example embodiment provided in accordance with the present system embodiments.

Referring now to FIG. 3, one example embodiment of the present redundant system embodiments is shown with various elements (e.g., inflation devices, control systems, power sources, and other elements described above) omitted for convenience of disclosure. A substantially inflated inflatable device 52 is positioned around the external surface configuration of a utility structure 54. In one aspect, the inflatable device 52 is divided into two or more segments 56,58,60, 62,64 to permit the inflatable device 52 to be capable of being folded into, or unfolded from, a relatively compact, readily transportable state. In another aspect, two enclosure pieces 66,68 are positioned/connected in operative association with the inflatable device 52 to create a substantially closed interior volume within the inflatable device 52 and to resist fluid media from exiting the inflatable device 52. It can be seen that use of the enclosure pieces 66,68 can provide a pathway 70 through the inflatable device 52 to the utility structure 54. In another aspect, a ladder 72, for example, or another suitable climbing apparatus, can be introduced within the pathway 70 and placed in contact with the utility structure 54 to permit a worker, for example, to scale the utility structure 54 and perform work at an elevated position adjacent to the utility structure 54.

Figure 4C:
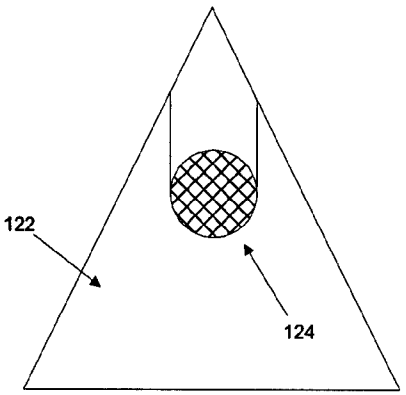
FIGS. 4A through 4D include various plan views of various example embodiments provided in accordance with the present system embodiments; and, FIG. 5 includes a schematic view of various example embodiments provided in accordance with the present system embodiments.
Figure 4D:
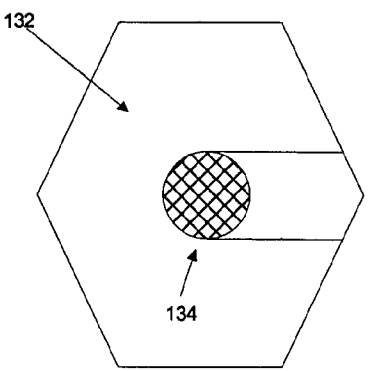
Figure 4A:
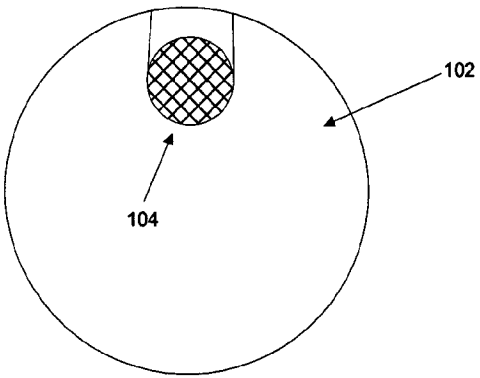
Figure 4B:
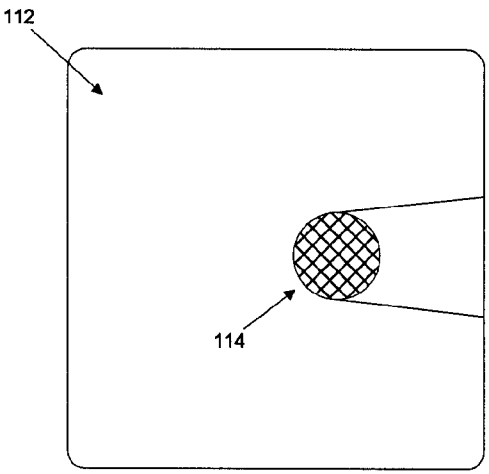

Referring now to FIGS. 4A through 4B, various alternative example embodiments are provided in accordance with the present redundant system embodiments. In one example shown in FIG. 4A, an inflatable device 102 having a generally circular body is positioned to enclose a portion of an external surface configuration perimeter of a utility structure 104. In this example, the utility structure 104 is positioned off-center with respect to a center of the inflatable device 102. In another example shown in FIG. 4B, an inflatable device 112 having a generally square body is positioned to enclose a portion of an external surface configuration perimeter of a utility structure 114. In another example shown in FIG. 4C, an inflatable device 122 having a generally triangular body is positioned to enclose a portion of an external surface configuration perimeter of a utility structure 124. In another example shown in FIG. 4D, an inflatable device 132 having a generally hexagonal body is positioned to enclose a portion of an external surface configuration perimeter of a utility structure 134. It can be seen that various redundant system embodiments disclosed herein can be provided with inflatable devices of many different dimensions, shapes and opening configurations. In addition, in each redundant system embodiment described herein, it can be appreciated that the position of a utility structure can be varied in many ways relative to the position of a body of an inflatable device enclosing a portion of the external surface configuration perimeter of the utility structure. It can be further appreciated that selection of the size, shape and other dimensions of an inflatable device can be based, at least in part, on the dimensions and type of a given utility structure, such as its external surface configuration perimeter, for example, and one or more trajectories expected to result from descending objects, for example, that may fall from the utility structure.

Figure 5:
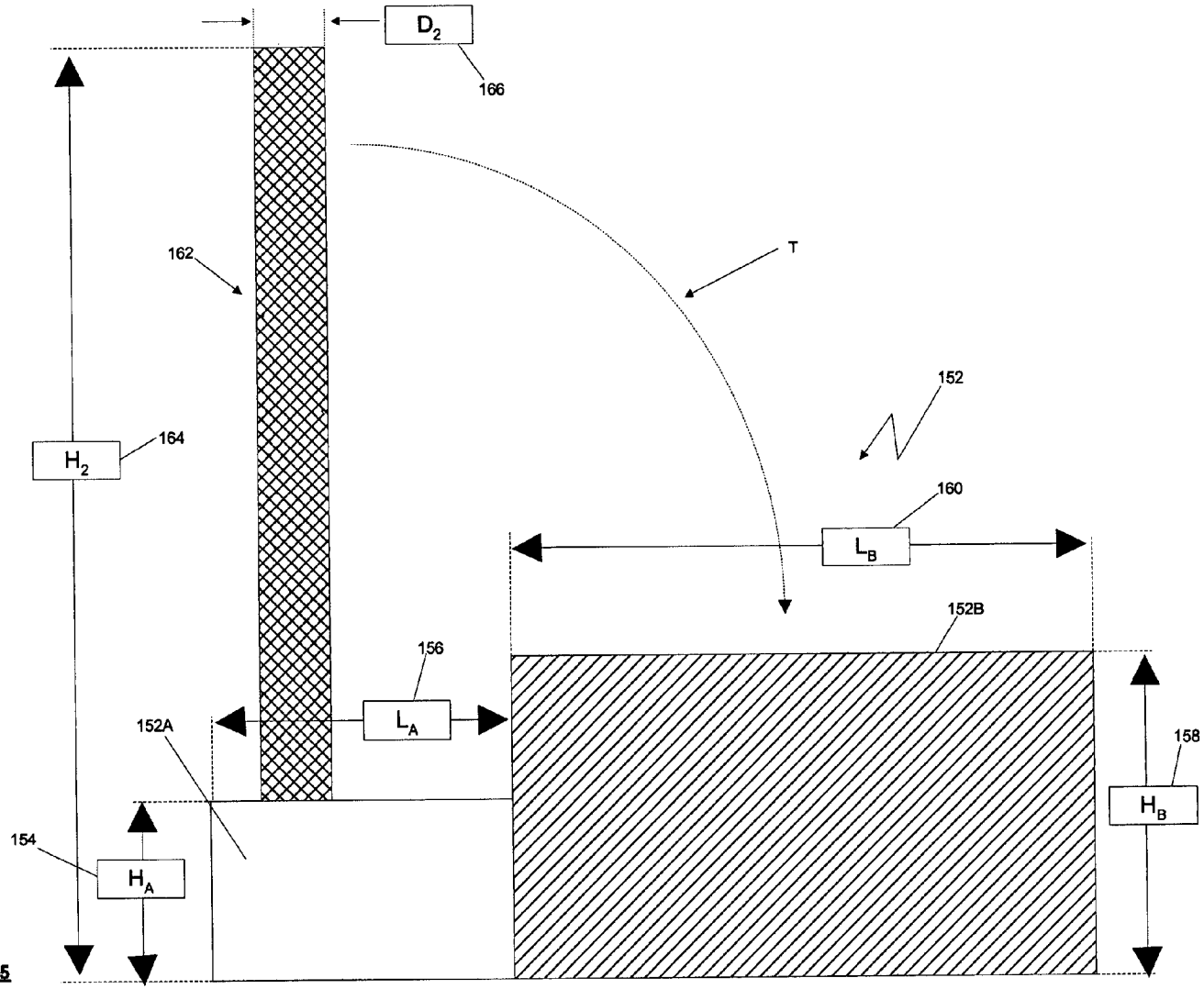

Referring now to FIG. 5, various example embodiments of the present redundant system embodiments are shown schematically. An inflatable device 152 having a first portion 152A with dimensions including a height $H_A$ (154) and a length $L_A$ (156) and a second portion 152B with dimensions including a height $H_B$ (158) and a length $L_B$, (160) is positioned to enclose at least a portion of the external surface configuration perimeter of a utility structure 162 having dimensions including a height $H_2$ (164) and a diameter $D_2$ (166). In one aspect, the height $H_A$ (154) of the first portion 152A of the inflatable device 152 can be less than the height $H_B$ (158) of the second portion 152B of the inflatable device 152. In another aspect, the length $L_A$ (156) of the first portion 152A of the inflatable device 152 can be less than the length $L_B$ (160) of the second portion 152B of the inflatable device 152.

In further aspects, it can be appreciated that the various dimensions of the first portion 152A of the inflatable device 152 and the second portion 152B of the inflatable device 152, in view of a descending object following the trajectory T, for example, can be appropriately selected to promote impact of the descending object (e.g., in the event of the descending object falling from the utility structure 162) on the second portion 152B of the inflatable device 152, rather than impact on the first portion 152A of the inflatable device 152. In this example, it can be seen that the total volume of fluid media required to inflate the inflatable device 152 may be reduced in comparison to other embodiments discussed herein, because the first portion 152A of the inflatable device 152 requires less such fluid media than the second portion 152B of the inflatable device 152. In addition, dimensions of the first and second portions 152A, 152B can be selected such that the expected location of impact for potential descending objects primarily includes a portion of the second portion 152B of the inflatable device 152. In the example embodiment shown, the second portion 152B of the inflatable device 152 maintains a capacity (due to the relative dimensions of $L_B$ (160) and $H_B$ (158) in comparison to the dimensions $H_A$ (154) and $L_A$ (156)) greater than that of the first portion 152A of the inflatable device 152 for absorbing and/or communicating force caused by the potential impact of a descending object which may descend along the trajectory T, or other potential trajectories.

It can be appreciated that choice of materials for construction/manufacture of the various structural elements disclosed herein is driven, at least in part, by the motivation to provide redundant system embodiments including inflatable devices that are relatively lightweight, relatively compact, readily manipulated and structurally sound. It can be further appreciated that such materials can be selected to promote convenience of transportation and manipulation of the various aspects and components of the redundant system embodiments in association with use of the redundant systems in connection with work performed on an elevated structure, for example.

The term "computer-readable medium" is defined herein as understood by those skilled in the art. It can be appreciated, for example, that method steps described herein may be performed, in certain embodiments, using instructions stored on a computer-readable medium or media that direct a computer system to perform the method steps. A computer-readable medium can include, for example, memory devices such as diskettes, compact discs of both read-only and writeable varieties, optical disk drives, and hard disk drives. A computer-readable medium can also include memory storage that can be physical, virtual, permanent, temporary, semi-permanent and/or semi-temporary. A computer-readable medium can further include one or more data signals transmitted on one or more carrier waves.

As used herein, a "computer" or "computer system" may be a wireless or wireline variety of a microcomputer, minicomputer, laptop, personal data assistant (PDA), cellular phone, pager, processor, or any other computerized device capable of configuration for transmitting and receiving data over a network. Computer systems and other devices disclosed herein can include memory for storing certain software applications used in obtaining, processing and communicating data. It can be appreciated that such memory can be internal or external. The memory can also include any means for storing software, including a hard disk, an optical disk, floppy disk, ROM (read only memory), RAM (random access memory), PROM (programmable ROM), EEPROM (extended erasable PROM), and other like computer-readable media.

The examples presented herein are intended to illustrate potential implementations of the present method and system embodiments. It can be appreciated that such examples are intended primarily for purposes of illustration. No particular aspect or aspects of the example method and system embodiments described herein are intended to limit the scope of the present invention. The configuration and specific functions of a particular inflatable device, for example, are provided merely for convenience of disclosure.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

It can be appreciated that, in some embodiments of the present methods and systems disclosed herein, a single component can be replaced by multiple components, and multiple components replaced by a single component, to perform a given function. Except where such substitution would not be operative to practice the present methods and systems, such substitution is within the scope of the present invention.

Whereas particular embodiments of the invention have been described herein for the purpose of illustrating the invention and not for the purpose of limiting the same, it can be appreciated by those of ordinary skill in the art that numerous variations of the details, materials and arrangement of parts may be made within the principle and scope of the invention without departing from the invention as described in the appended claims.

What is claimed is:

1. A redundant system comprising:

a utility structure having an external surface configuration perimeter;

an inflatable device including a body having at least one surface structured for receiving an impact of at least one descending object, said body defining at least one opening structured to receive therein at least a portion of said external surface configuration perimeter of said utility structure;

at least one inlet operatively associated with said body of said inflatable device, said inlet structured to receive at least one type of fluid media into said body for inflating said inflatable device;

at least one inflation device operatively associated with said inlet of said inflatable device; and at least one control system configured for operative association with at least one of said inflation devices.

2. The system of claim 1, further comprising at least one exhaust port operatively associated with said body of said inflatable device.

3. The system of claim 2, wherein at least one of said exhaust ports includes a breakable membrane.

4. The system of claim 2, wherein at least one of said exhaust ports includes a flap.

5. The system of claim 1, wherein a diameter of said inflatable device is related to a height of said utility structure.

6. The system of claim 1, further comprising at least one communication device configured for communicating commands to at least one of said control systems.

7. The system of claim 6, where said communication device includes a communication device selected from the group consisting of a remote control device, a laptop, a personal digital assistant, and a telephone.

8. The system of claim 6, further comprising at least one communication media configured for communicating said commands to said control systems.

9. The system of claim 1, further comprising at least one power source configured for supplying power to at least one of said inflation devices.

10. The system of claim 9, wherein at least one of said power sources includes a battery of a maintenance vehicle.

11. The system of claim 1, wherein said body of said inflatable device includes at least two segments.

12. The system of claim 1, further comprising at least one enclosure piece structured for creating a substantially closed interior volume within said body of said inflatable device.

13. The system of claim 12, further comprising a pathway formed in said body of said inflatable device.

14. The system of claim 1, wherein said body of said inflatable device includes a shape selected from the group consisting of a generally circular body shape, a generally square body shape, a generally triangular body shape, and a generally hexagonal body shape.

15. The system of claim 14, wherein said opening is located off-center with respect to a center of the inflatable device.

16. The system of claim 1, wherein said opening is located within a perimeter of said body.

17. The redundant system of claim 1, wherein the at least one opening is defined within a first portion of said body and the surface structured for receiving an impact of the at least one descending object is located within a second portion of said body.

18. The system of claim 17, wherein a height of the second portion of said body is greater than a height of the first portion of said body.

19. The system of claim 17, wherein a length of the second portion of said body is greater than a length of the first portion of said body.

20. A redundant system structured for use in association with a utility structure having an external surface configuration perimeter, said system comprising:

an inflatable device including a body having at least one surface structured for receiving an impact of at least one descending object, said body defining at least one opening structured to receive therein at least a portion of said external surface configuration perimeter of said utility structure;

at least one inlet operatively associated with said body of said inflatable device, said inlet structured to receive at least one type of fluid media into said body for inflating said inflatable device;

at least one exhaust port operatively associated with said body of said inflatable device;

at least one inflation device operatively associated with said inlet of said inflatable device;

at least one control system configured for operative association with at least one of said inflation devices;

at least one power source configured for supplying power to at least one of said inflation devices, wherein at least one of said power sources includes a battery of a maintenance vehicle; and, at least one communication device configured for communicating commands to at least one of said control systems.

* * * * *